US011100833B2

(12) United States Patent
Xu

(10) Patent No.: US 11,100,833 B2
(45) Date of Patent: Aug. 24, 2021

(54) DISPLAY DEVICE AND DRIVING METHOD THEREOF

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventor: Yingsong Xu, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/609,016

(22) PCT Filed: Mar. 7, 2019

(86) PCT No.: PCT/CN2019/077295
§ 371 (c)(1),
(2) Date: Oct. 28, 2019

(87) PCT Pub. No.: WO2019/196578
PCT Pub. Date: Oct. 17, 2019

(65) Prior Publication Data

US 2020/0143729 A1 May 7, 2020

(30) Foreign Application Priority Data

Apr. 9, 2018 (CN) ..... 201810311914.8

(51) Int. Cl.
*G09G 3/20* (2006.01)

(52) U.S. Cl.
CPC ..... *G09G 3/20* (2013.01); *G09G 2300/0465* (2013.01); *G09G 2380/02* (2013.01)

(58) Field of Classification Search
CPC combination set(s) only.
See application file for complete search history.

(56) References Cited

U.S. PATENT DOCUMENTS

2009/0121983 A1* 5/2009 Sung ..... H01L 27/3218 345/76
2015/0262529 A1* 9/2015 Lee ..... G09G 3/3233 345/76

(Continued)

FOREIGN PATENT DOCUMENTS

CN 103295510 A 9/2013
CN 104464620 A 3/2015

(Continued)

OTHER PUBLICATIONS

First Office Action dated Dec. 18, 2019 corresponding to Chinese application No. 201810311914.8.

*Primary Examiner* — Van N Chow
(74) *Attorney, Agent, or Firm* — Nath, Goldberg & Meyer; Joshua B. Goldberg

(57) ABSTRACT

The disclosure provides a display device including a stretchable display panel that includes multiple rows and columns of conventional pixels and a controller, a row of compensation pixels are between at least two adjacent rows of conventional pixels, and a column of compensation pixels are between at least two adjacent columns of conventional pixels. The controller is configured to: drive the compensation pixels between two adjacent columns of conventional pixels to emit light, when the stretchable display panel in a display state is stretched in a row direction; drive the compensation pixels between two adjacent rows of conventional pixels to emit light, when the stretchable display panel in the display state is stretched in a column direction; and control the compensation pixels not to emit light when the (Continued)

stretchable display panel is not stretched. The disclosure further provides a driving method of a display device.

9 Claims, 3 Drawing Sheets

(56) References Cited

U.S. PATENT DOCUMENTS

| | | | | |
|---|---|---|---|---|
| 2016/0077553 | A1* | 3/2016 | Hyun | G09G 3/3208 345/690 |
| 2018/0247985 | A1* | 8/2018 | Jeon | H01L 51/0097 |

FOREIGN PATENT DOCUMENTS

| | | | |
|---|---|---|---|
| CN | 105575309 | A | 5/2016 |
| CN | 107331343 | A | 11/2017 |
| CN | 108492762 | A | 9/2018 |
| CN | 208189154 | U | 12/2018 |
| JP | 2001-311960 | A | 11/2001 |

* cited by examiner

DISPLAY DEVICE AND DRIVING METHOD THEREOF

CROSS-REFERENCE TO RELATED APPLICATION

This is a National Phase Application filed under 35 U.S.C. 371 as a national stage of PCT/CN2019/077295, filed on Mar. 7, 2019, an application claims the benefit of priority to Chinese Patent Application No. 201810311914.8 filed on Apr. 9, 2018, the contents of which are incorporated herein in their entirety by reference.

TECHNICAL FIELD

The present disclosure relates to the field of display technologies, and in particular, to a display device and a driving method thereof.

BACKGROUND

Stretchable display has attracted increased attention as a type of wearable display. After a screen as a stretchable display product is stretched, the distance between pixels may be increased and the resolution is reduced. As a result, the resolutions before and after stretching are different, and the user experience is poor.

SUMMARY

According to an aspect of the present disclosure, there is provided a display device including a stretchable display panel and a controller, the stretchable display panel includes multiple rows and multiple columns of conventional pixels, a row of compensation pixels are between at least two adjacent rows of conventional pixels, and a column of compensation pixels are between at least two adjacent columns of conventional pixels. The controller is configured to: drive the compensation pixels between two adjacent columns of conventional pixels to emit light, in response to the stretchable display panel in a display state being stretched in a row direction; drive the compensation pixels between two adjacent rows of conventional pixels to emit light, in response to the stretchable display panel in the display state being stretched in a column direction; and control the compensation pixels not to emit light in response to the stretchable display panel being not stretched.

According to an embodiment of the present disclosure, the compensation pixels are disposed between any two adjacent columns of conventional pixels.

According to an embodiment of the present disclosure, the stretchable display panel includes a display area and a peripheral area around the display area, and the conventional pixels and the compensation pixels are in the display area. The controller is in the peripheral area and at one side of the display area along the row direction, and includes one control component or a plurality of control components arranged along the column direction. Each control component corresponds to a plurality of rows of conventional pixels in the row direction, and the compensation pixels are provided between any two adjacent rows of conventional pixels that do not correspond to the control components.

According to an embodiment of the present disclosure, among the compensation pixels between two adjacent rows of conventional pixels, each compensation pixel has a size in the column direction smaller than a size in the column direction of the conventional pixel in the same column as the compensation pixel, and among the compensation pixels between two adjacent columns of conventional pixels, each compensation pixel has a size in the row direction smaller than a size in the row direction of the conventional pixel in the same row as the compensation pixel.

According to an embodiment of the present disclosure, the conventional pixels constitute a plurality of pixel units, each pixel unit includes a plurality of conventional pixels arranged in the column direction, colors of the plurality of conventional pixels in a same pixel unit are different from each other, and colors of the conventional pixels in a same row are the same. Among the compensation pixels between two adjacent columns of conventional pixels, each compensation pixel has a color that is the same as a color of the conventional pixel in the same row as the compensation pixel, and among the compensation pixels between two adjacent rows of conventional pixels, each compensation pixel has a color that is the same as a color of one of the two adjacent rows of conventional pixels, and the compensation pixels in the same row have a same color.

According to an embodiment of the present disclosure, at least one first conductive line extending in the row direction and at least one second conductive line extending in the column direction are on the stretchable display panel. The controller is further configured to: detect resistances of the first and second conductive lines, determine that the stretchable display panel is stretched in the row direction, in response to the resistance of the first conductive line increasing from its initial value to a first threshold value, and determine that the stretchable display panel is stretched in the column direction, in response to the resistance of the second conductive line increasing from its initial value to a second threshold value.

According to an embodiment of the present disclosure, a plurality of first conductive lines and a plurality of second conductive lines are on the stretchable display panel.

According to an embodiment of the present disclosure, the row direction is a length direction of the stretchable display panel, and the column direction is a width direction of the stretchable display panel.

According to an embodiment of the present disclosure, the display device further includes a first gate driving circuit and a second gate driving circuit. The first gate driving circuit is configured to scan the conventional pixels column by column, and the controller is configured to provide data signals to the scanned conventional pixels. The second gate driving circuit is configured to scan the compensation pixels column by column, and the controller is configured to provide data signals to the scanned compensation pixels.

According to another aspect of the present disclosure, there is provided a driving method of a display device, the display device includes a stretchable display panel, the stretchable display panel includes multiple rows and multiple columns of conventional pixels, a row of compensation pixels is between at least two adjacent rows of conventional pixels, and a column of compensation pixels is between at least two adjacent columns of conventional pixels. The method includes: acquiring a state of the stretchable display panel; driving the compensation pixels between two adjacent columns of conventional pixels to emit light, in response to the stretchable display panel in a display state being stretched in a row direction; driving the compensation pixels between two adjacent rows of conventional pixels to emit light, in response to the stretchable display panel in the display state being stretched in a column direction; and controlling the compensation pixels not to emit light, in response to the stretchable display panel being not stretched.

According to another aspect of the present disclosure, at least one first conductive line extending in the row direction and at least one second conductive line extending in the column direction are on the stretchable display panel, and the method further includes: detecting resistances of the first conductive line and the second conductive line; determining that the stretchable display panel is stretched in the row direction, in response to the resistance of the first conductive line increasing from its initial value to a first threshold value; and determining that the stretchable display panel is stretched in the column direction, in response to the resistance of the second conductive line increasing from its initial value to a second threshold value.

According to another aspect of the present disclosure, the display device further includes a first gate driving circuit and a second gate driving circuit. The method further includes: scanning, by the first gate driving circuit, the conventional pixels column by column and supplying data signals to the scanned conventional pixels; and scanning, by the second gate driving circuit, the compensation pixels column by column, and supplying data signals to the scanned compensation pixels.

BRIEF DESCRIPTION OF THE DRAWINGS

The accompanying drawings, which serve to provide a further understanding of the present disclosure and constitute a part of this specification, are used for explaining the present disclosure together with the following specific implementations, rather than limiting the present disclosure. In the drawings.

DETAILED DESCRIPTION

Specific implementations of the present disclosure will be described in detail below in conjunction with the accompanying drawings. It should be understood that, the specific implementations described herein are merely used for describing and explaining the present disclosure, rather than limiting the present disclosure.

Figure 1:
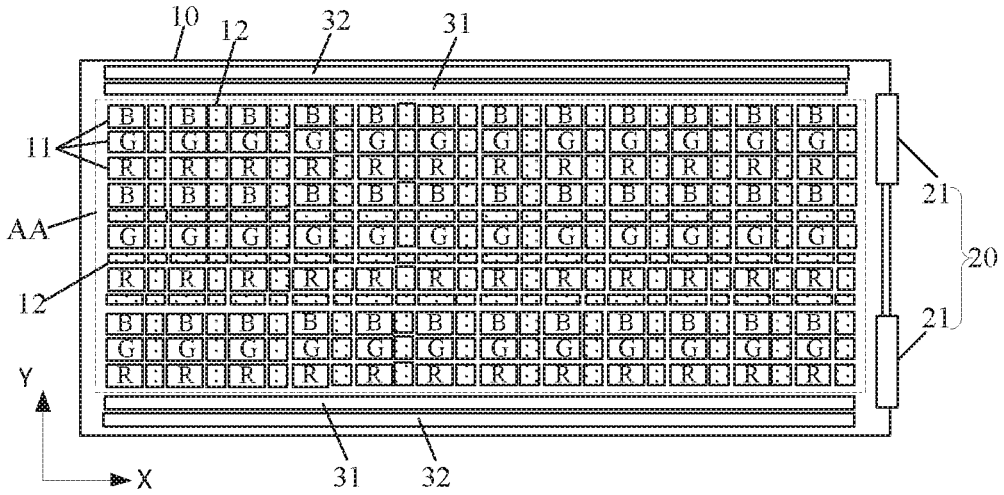
FIG. 1 is a schematic structural diagram of a display device according to an embodiment of the present disclosure.
Figure 2:
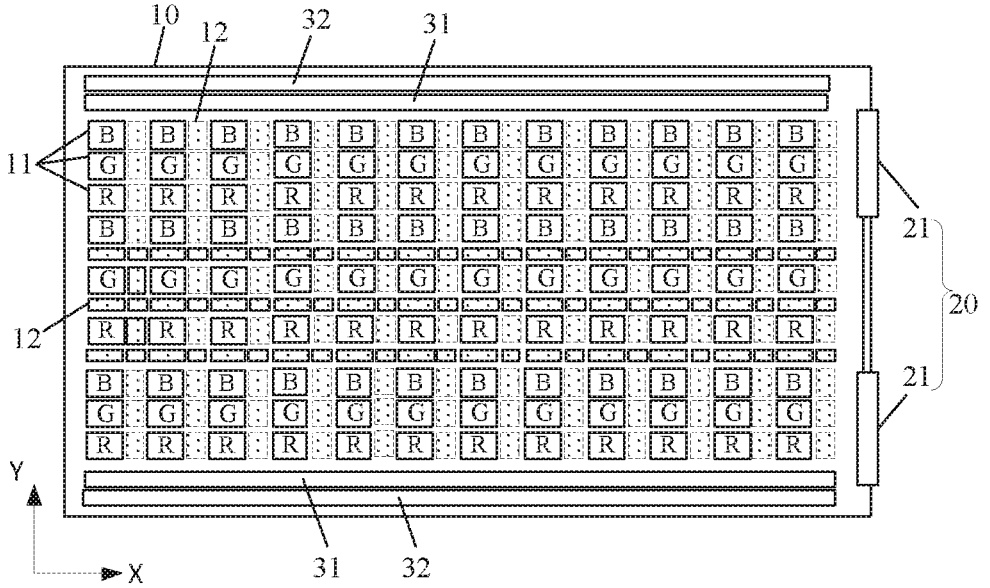
FIG. 2 is a schematic diagram of light emitting states of pixels when a stretchable display panel of a display device according to an embodiment of the present disclosure is stretched in a column direction.
Figure 3:
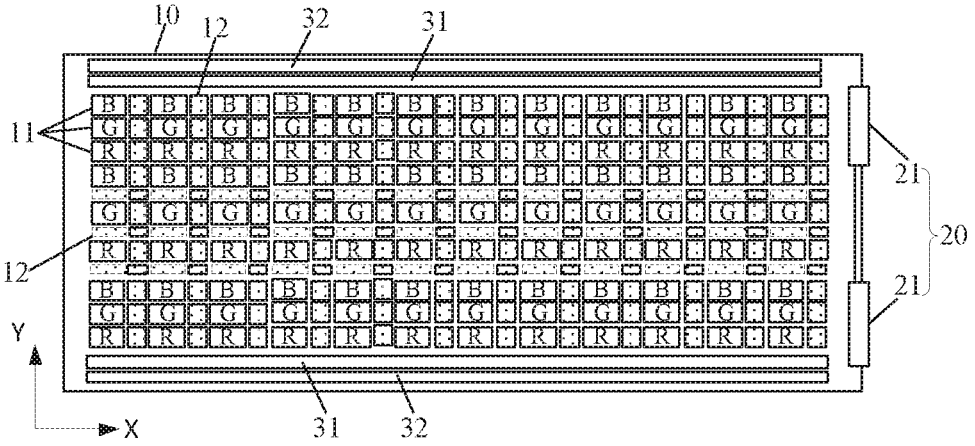
FIG. 3 is a schematic diagram of light emitting states of pixels when a stretchable display panel of a display device according to an embodiment of the present disclosure is stretched in a row direction.

The present disclosure provides a display device. FIG. 1 is a schematic structural diagram of a display device according to an embodiment of the present disclosure, FIG. 2 is a schematic diagram of light emitting states of pixels when a stretchable display panel of a display device according to an embodiment of the present disclosure is stretched in a column direction, and FIG. 3 is a schematic diagram of light emitting states of pixels when a stretchable display panel of a display device according to an embodiment of the present disclosure is stretched in a row direction. In FIGS. 2 and 3, in order to distinguish a pixel that emits light from a pixel that does not emit light, the pixel that emits light is denoted as a box with a solid line, and the pixel that does not emit light is denoted as a box with a dotted line.

Referring to FIGS. 1 to 3, a display device according to an embodiment of the present disclosure includes a stretchable display panel 10 and a controller 20. The stretchable display panel 10 includes a plurality of rows and columns of conventional pixels 11 (red (R), green (G) and blue (B) pixels shown in FIGS. 1 to 3), a row of compensation pixels 12 are disposed between at least two adjacent rows of conventional pixels 11, and a column of compensation pixels 12 are disposed between at least two adjacent columns of conventional pixels 11. The controller 20 is configured to drive the compensation pixels 12 between two adjacent columns of conventional pixels 11 to emit light when the stretchable display panel 10 in a display state is stretched in a row direction, drive the compensation pixels 12 between two adjacent rows of conventional pixels 11 to emit light when the stretchable display panel 10 in the display state is stretched in a column direction, and control the compensation pixels 12 not to emit light when the stretchable display panel 10 is not stretched. It should be noted that the stretchable display panel 10 may be stretched in both the row direction and the column direction, and in this case, each of the compensation pixels 12 emits light.

In the present disclosure, when the stretchable display panel 10 is not stretched in the display state, the distance between the adjacent conventional pixels 11 is small and the compensation pixels 12 do not emit light. When the stretchable display panel 10 is stretched in the column direction in the display state, although the pitch between adjacent rows of the conventional pixels 11 is increased, the number of pixels emitting light per unit area is not excessively reduced because the compensation pixels 12 disposed between at least two adjacent rows of conventional pixels 11 emit light, thereby alleviating the phenomenon of resolution degradation after the stretchable display panel 10 is stretched in the column direction. Similarly, when the stretchable display panel 10 is stretched in the row direction in the display state, although the pitch between adjacent columns of conventional pixels 11 is increased, the compensation pixels 12 between at least two adjacent rows of conventional pixels 11 emit light, so that the phenomenon of resolution degradation after the stretchable display panel 10 is stretched in the row direction is alleviated, thereby allowing the resolutions of the display panel before and after stretching to be close, and improving the user experience.

The row direction is a length direction of the stretchable display panel 10, e.g., the X direction shown in FIGS. 1 to 3, and the column direction is a width direction of the stretchable display panel 10, e.g., the Y direction shown in FIGS. 1 to 3.

Figure 6:
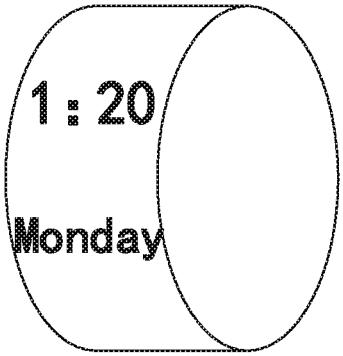
FIG. 6 is a schematic diagram of a display device according to an embodiment of the present disclosure as a stretchable bracelet.

The display device according to the embodiment of the present disclosure is applicable to a wearable device such as a bracelet, for example, as shown in FIG. 6, the display device according to the embodiment of the present disclosure is applicable to a stretchable bracelet, and stretching of the stretchable display panel 10 in the row direction may be result in an increase of a length of the stretchable bracelet.

In one embodiment, as shown in FIGS. 1 to 3, a column of compensation pixels 12 are disposed between any two adjacent columns of conventional pixels 11, so that when the stretchable display panel 10 is stretched in the row direction, the pitch between any two adjacent columns of light-emitting pixels is not too large, so as to ensure that granular sensation due to resolution reduction will not be caused at any position of the stretchable display panel 10, and ensure display uniformity. In one embodiment, the compensation pixels 12 may also be provided before the first column of conventional pixels 11 (the leftmost column of conventional pixels in the figure) and after the last column of conventional pixels 11 (the rightmost column of conventional pixels in the figure).

As shown in FIG. 1, the stretchable display panel 10 is divided into a display area AA and a peripheral area located around the display area AA. The conventional pixels 11 and the compensation pixels 12 are both located in the display area AA, and the controller 20 is disposed in the peripheral area and located at one side of the display area AA in the row direction. The controller 20 may include one control component 21 or a plurality of control components 21 arranged in the column direction. Each control component 21 corresponds to a plurality of rows of conventional pixels 11 in the row direction. In the context of the present disclosure, "a control component corresponds to a plurality of rows of conventional pixels in the row direction" means that the position of the control component overlaps with positions of the plurality of rows of conventional pixels in the row direction. For example, referring to FIG. 1, the position of the control component 21 at the upper part in the figure overlaps with the positions of the first three rows of conventional pixels 11 of the display panel 10 in the row direction, and thus the control component 21 at the upper part in the figure corresponds to the first three rows of conventional pixels 11. It should be appreciated that this example is merely illustrative and do not limit the scope of the present disclosure. In the embodiments shown in FIGS. 1 to 3, the controller 20 includes a plurality of control components 21, and the control components 21 are spaced apart from each other and electrically connected by signal lines.

In order to make the pitch between any two rows of light-emitting pixels not too large when the stretchable display panel 10 is stretched in the column direction, and thus make the light-emitting pixels distributed more uniformly, according to the embodiment of the present disclosure, the compensation pixels 12 are provided between any two adjacent rows of conventional pixels 11 which do not correspond to the control component 21, that is, between any two adjacent rows of conventional pixels 11 of which the positions do not overlap with the position of the control component 21 in the row direction. Since the control component 21 generally includes a structure such as a driving chip that is not easily stretched, the row pitch of the rows of conventional pixels 11 corresponding to the control component 21 does not change when the stretchable display panel 10 is stretched in the column direction, and thus the compensation pixels 12 may not be disposed between the rows of conventional pixels 11 corresponding to the control component 21.

Figure 4:
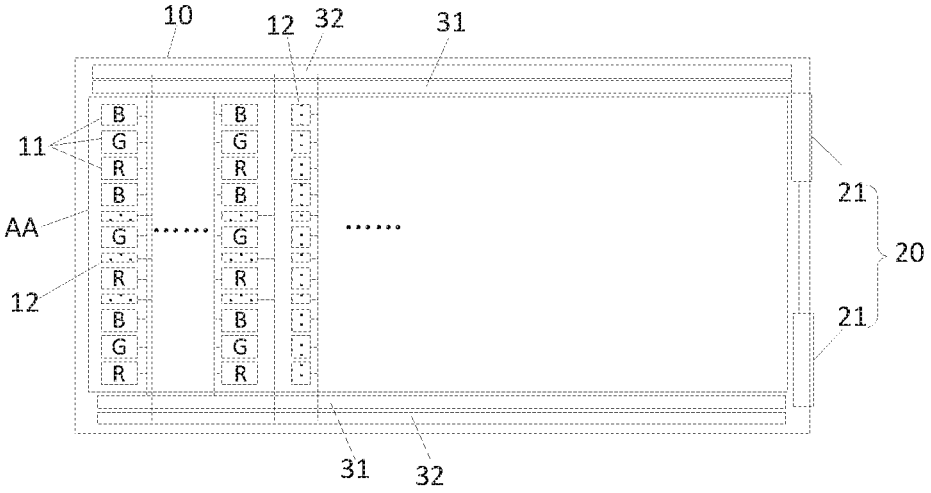
FIG. 4 is a schematic diagram illustrating connection between first and second gate driving circuits and pixels of a display device according to an embodiment of the present disclosure.

FIG. 4 is a schematic diagram illustrating connection between first and second gate driving circuits and pixels of a display device according to an embodiment of the present disclosure.

As shown in FIG. 4, the display device according to the embodiment of the present disclosure may further include a first gate driving circuit and a second gate driving circuit. The first gate driving circuit is configured to scan the conventional pixels 11 column by column, and the controller 20 provides data signals to the scanned conventional pixels 11 to cause the conventional pixels 11 to emit light. The second gate driving circuit is configured to scan the compensation pixels 12 column by column and the controller 20 provides data signals to the scanned compensation pixels 12 to cause the compensation pixels 12 to emit light. The light emission luminance of the compensation pixel 12 may be the same as the light emission luminance of one of the conventional pixels 11 adjacent thereto, or may be the average light emission luminance of the conventional pixels 11 adjacent thereto.

Both the first gate driving circuit and the second gate driving circuit may be disposed in the peripheral area of the display panel 10. As shown in FIG. 4, the first gate driving circuit may include two first shift registers 31 respectively disposed at both sides of the display area AA along the column direction, each first shift register 31 includes a plurality of first shift register units cascaded, and each first shift register unit corresponds to one column of conventional pixels 11 to supply a scan signal to the column of conventional pixels 11. The second gate driving circuit may include two second shift registers 32 respectively disposed at both sides of the display area AA in the column direction, each second shift register 32 includes a plurality of second shift register units cascaded, and each second shift register unit corresponds to one column of compensation pixels 12 to provide a scan signal to the column of compensation pixels 12. Each first shift register unit corresponds to one column of conventional pixels 11 and each second shift register unit corresponds to one column of compensation pixels 12, so as to prevent the first shift register unit and the second shift register unit from affecting the stretching of the stretchable display panel 10 in the row direction. In the context of the present disclosure, "the shift register unit corresponds to one column of pixels" means that the position of the shift register unit overlaps with the position of the column of pixels in the column direction.

In order to prevent the pitch between the emitting-light pixels from being excessively large when the stretchable display panel 10 is not stretched, according to an embodiment of the present disclosure, the size of the compensation pixel 12 is smaller than that of the conventional pixel 11. In an embodiment, for the compensation pixels 12 between two adjacent rows of conventional pixels 11, the size of each compensation pixel 12 in the column direction is smaller than the size of the conventional pixel 11 in the same column as the compensation pixel 12 in the column direction, and for the compensation pixels 12 between two adjacent columns of conventional pixels 11, the size of each compensation pixel 12 in the row direction is smaller than the size of the conventional pixel 11 in the same row as the compensation pixel 12 in the row direction.

The display device of the present disclosure may be a color display device, the conventional pixels 11 may constitute a plurality of pixel units, each pixel unit may include a plurality of conventional pixels 11 arranged in a column direction, and colors of the plurality of conventional pixels 11 included in a same pixel unit are different from each other. As shown in FIGS. 1 to 3, the colors of the plurality of conventional pixels 11 in one pixel unit are red (R), green (G), and blue (B), respectively, but the present disclosure is not limited thereto. Further, the colors of the conventional pixels 11 in the same row are the same.

For the compensation pixels 12 between two adjacent columns of conventional pixels 11, the color of each compensation pixel 12 is the same as the color of the conventional pixel 11 in the row in which the compensation pixel 12 is located. For the compensation pixels 12 between two adjacent rows of conventional pixels 11, the color of each compensation pixel 12 is the same as the color of one of the two adjacent rows of conventional pixels 11, and the colors of the compensation pixels 12 in the same row are the same. For example, for the compensation pixels 12 between the n-th row and the (n+1)-th row of conventional pixels 11, the color of each compensation pixel 12 may be the same as the color of the n-th row of conventional pixels 11; alternatively, the color of each compensation pixel 12 may be the same as the color of the (n+1)-th row of conventional pixels 11.

Figure 5:
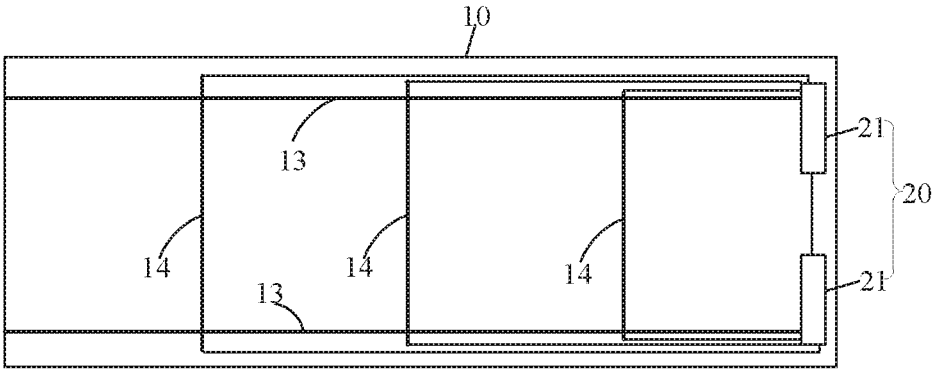
FIG. 5 is a schematic diagram illustrating connection between first and second conductive lines and a controller on a stretchable display panel of a display device according to an embodiment of the present disclosure.

FIG. 5 is a schematic diagram illustrating connection between first and second conductive lines and a controller on a stretchable display panel of a display device according to an embodiment of the present disclosure.

In practical applications, a stretching instruction may be manually input to the display device, and upon receipt of the instruction, the controller 20 may drive the corresponding compensation pixel 12 to emit light. In order to automatically detect whether the stretchable display panel 10 is stretched and the stretching direction, according to an embodiment of the present disclosure, as shown in FIG. 5, at least one first conductive line 13 extending in the row direction and at least one second conductive line 14 extending in the column direction are disposed on the stretchable display panel 10. The controller 20 is further configured to detect the resistances of the first and second conductive lines 13 and 14, determine that the stretchable display panel 10 is stretched in the row direction when the resistance of the first conductive line 13 increases from its initial value to a first threshold value, and determine that the stretchable display panel 10 is stretched in the column direction when the resistance of the second conductive line 14 increases from its initial value to a second threshold value.

The first conductive line 13 and the second conductive line 14 each have a certain ductility. When the stretchable display panel 10 is stretched in the row direction, the first conductive line 13 becomes longer and thinner so that the resistance increases, and when the resistance of the first conductive line 13 increases to the first threshold value, the controller 20 may determine that the stretchable display panel 10 is stretched in the row direction. When the stretchable display panel 10 is stretched in the column direction, the second conductive line 14 becomes longer and thinner so that the resistance increases, and when the resistance of the second conductive line 14 increases to the second threshold value, the controller 20 may determine that the stretchable display panel 10 is stretched in the column direction. In addition, when the resistances of the first conductive line 13 and the second conductive line 14 increase to the first threshold value and the second threshold value, respectively, it indicates that the stretchable display panel 10 is stretched in both the row direction and the column direction at the same time, and the controller 20 may drive the respective compensation pixels 12 to emit light at the same time.

According to the embodiment of the present disclosure, a plurality of first conductive lines and a plurality of second conductive lines may be provided, and as shown in FIG. 5, the number of the first conductive lines 13 is two, and the number of the second conductive lines 14 is three, but the present disclosure is not limited thereto, and the number of the first conductive lines 13 and the second conductive lines 14 may be provided according to actual needs.

Although it is described in the above-described embodiment that one column of compensation pixels 12 is provided between two adjacent columns of conventional pixels 11 and one row of compensation pixels 12 is provided between two adjacent rows of conventional pixels 11 which do not correspond to the control component 21, the present disclosure is not limited thereto. According to an embodiment of the present disclosure, two or more columns of compensation pixels 12 may be disposed between two adjacent columns of conventional pixels 11, and two or more rows of compensation pixels 12 may be disposed between two adjacent rows of conventional pixels 11 that do not correspond to the control component 21. In this case, the controller 20 may control the number of columns and/or rows of compensation pixels 12 that are required to emit light for compensation according to the change of the resistance of the first conductive line 13 and/or the second conductive line 14. For example, in a case where two columns of compensation pixels 12 are disposed between two adjacent columns of conventional pixels 11, when the resistance of the first conductive line 13 increases to a third threshold value, the controller 20 may control one of the two columns of compensation pixels 12 between two adjacent columns of conventional pixels 11 to emit light, and when the resistance of the first conductive line 13 increases to a fourth threshold value, the controller 20 may control both of the two columns of compensation pixels 12 between the two adjacent columns of conventional pixels 11 to emit light.

FIG. 6 is a schematic diagram of a display device according to an embodiment of the present disclosure as a stretchable bracelet.

According to the embodiment of the present disclosure, the display device may be applied to the stretchable bracelet, and in this case, one end of the first conductive line 13 may be fixedly connected to the controller 20, and the other end of the first conductive line 13 may be detachably connected to the controller 20. For example, when the stretchable bracelet forms a closed loop, the other end of the first conductive line 13 is connected to the controller 20, and when the stretchable bracelet is opened, the other end of the first conductive line 13 is disconnected from the controller 20.

Embodiments of the present disclosure also provide a driving method of a display device including a stretchable display panel, the stretchable display panel includes a plurality of rows and columns of conventional pixels, a row of compensation pixels are disposed between at least two adjacent rows of conventional pixels, and a column of compensation pixels are disposed between at least two adjacent columns of conventional pixels.

Figure 7:
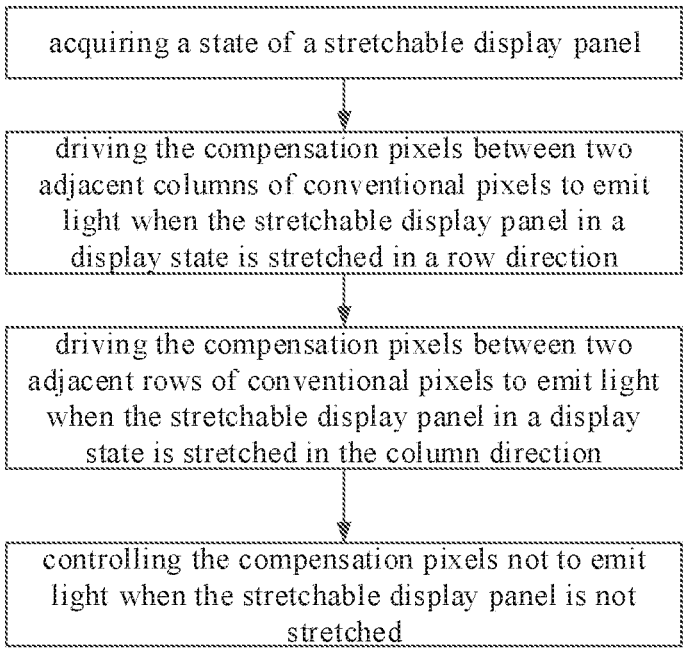
FIG. 7 is a flowchart of a driving method of a display device according to an embodiment of the present disclosure.

FIG. 7 is a flowchart of a driving method of a display device according to an embodiment of the present disclosure.

As shown in FIG. 7, a driving method of a display device according to an embodiment of the present disclosure includes: acquiring a state of a stretchable display panel; when the stretchable display panel in a display state is stretched in a row direction, driving the compensation pixels between two adjacent columns of conventional pixels to emit light; when the stretchable display panel in a display state is stretched in the column direction, driving the compensation pixels between two adjacent rows of conventional pixels to emit light; and controlling the compensation pixels not to emit light when the stretchable display panel is not stretched.

At least one first conductive line 13 extending in the row direction and at least one second conductive line 14 extending in the column direction may be disposed on the stretchable display panel 10 (see FIG. 5). The driving method of the display device according to the embodiment of the present disclosure may further include: detecting resistances of the first conductive line 13 and the second conductive line 14; determining that the stretchable display panel 10 is stretched in the row direction when the resistance of the first conductive line 13 increases from its initial value to a first threshold value; determining that the stretchable display panel 10 is stretched in the column direction when the resistance of the second conductive line 14 increases from its initial value to a second threshold value.

The display device further includes a first gate driving circuit and a second gate driving circuit (see FIG. 4). The driving method of the display device according to an embodiment of the present disclosure may further include: scanning, by the first gate driving circuit, the conventional pixels 11 column by column and supplying data signals to the scanned conventional pixels 11; and scanning, by the second gate driving circuit, the compensation pixels 12 column by column and supplying data signals to the scanned compensation pixels 12.

It could be understood that the above embodiments are merely exemplary embodiments adopted for describing the principle of the present disclosure, but the present disclosure is not limited thereto. Various variations and improvements may be made by those of ordinary skill in the art without departing from the spirit and essence of the present disclosure, and these variations and improvements shall also be regarded as falling into the protection scope of the present disclosure.

The invention claimed is:

1. A display device comprising a stretchable display panel and a controller, wherein the stretchable display panel comprises multiple rows and multiple columns of conventional pixels, a row of compensation pixels are between at least two adjacent rows of conventional pixels, and a column of compensation pixels are between at least two adjacent columns of conventional pixels, and the controller is configured to:

drive the compensation pixels between two adjacent columns of conventional pixels to emit light, in response to the stretchable display panel in a display state being stretched in a row direction;

drive the compensation pixels between two adjacent rows of conventional pixels to emit light, in response to the stretchable display panel in the display state being stretched in a column direction; and control the compensation pixels not to emit light, in response to the stretchable display panel being not stretched, wherein among the compensation pixels between two adjacent rows of conventional pixels, each compensation pixel has a size in the column direction smaller than a size in the column direction of the conventional pixel in the same column as the compensation pixel, among the compensation pixels between two adjacent columns of conventional pixels, each compensation pixel has a size in the row direction smaller than a size in the row direction of the conventional pixel in the same row as the compensation pixel, the display device comprises a first gate driving circuit and a second gate driving circuit; the first gate driving circuit is configured to scan the conventional pixels column by column, and the controller is configured to provide data signals to the scanned conventional pixels to make the conventional pixels emit light; and the second gate driving circuit is configured to scan the conventional pixels column by column, and the controller is configured to provide data signals to the scanned compensation pixels to make the compensation pixels emit light, and light emission luminance of the compensation pixels is an average light emission luminance of the conventional pixels adjacent thereto.

2. The display device of claim 1, wherein the compensation pixels are disposed between any two adjacent columns of conventional pixels.

3. The display device of claim 1, wherein the stretchable display panel comprises a display area and a peripheral area around the display area, and the conventional pixels and the compensation pixels are in the display area, the controller is in the peripheral area and at one side of the display area along the row direction, and comprises one control component or a plurality of control components arranged along the column direction, each control component corresponds to a plurality of rows of conventional pixels in the row direction, and the compensation pixels are provided between any two adjacent rows of conventional pixels that do not correspond to the control components.

4. The display device of claim 1, wherein the conventional pixels constitute a plurality of pixel units, each pixel unit comprises a plurality of conventional pixels arranged in the column direction, colors of the plurality of conventional pixels in a same pixel unit are different from each other, and colors of the conventional pixels in a same row are the same, among the compensation pixels between two adjacent columns of conventional pixels, each compensation pixel has a color that is the same as a color of the conventional pixel in the same row as the compensation pixel, and among the compensation pixels between two adjacent rows of conventional pixels, each compensation pixel has a color that is the same as a color of one of the two adjacent rows of conventional pixels, and the compensation pixels in the same row have a same color.

5. The display device of claim 1, wherein at least one first conductive line extending in the row direction and at least one second conductive line extending in the column direction are on the stretchable display panel, and the controller is further configured to:

detect resistances of the first and second conductive lines, determine that the stretchable display panel is stretched in the row direction, in response to the resistance of the first conductive line increasing from its initial value to a first threshold value, and determine that the stretchable display panel is stretched in the column direction, in response to the resistance of the second conductive line increasing from its initial value to a second threshold value.

6. The display device of claim 5, wherein a plurality of first conductive lines and a plurality of second conductive lines are on the stretchable display panel.

7. The display device of claim 1, wherein the row direction is a length direction of the stretchable display panel, and the column direction is a width direction of the stretchable display panel.

8. A driving method of a display device, the display device comprising a stretchable display panel, the stretchable display panel comprising multiple rows and multiple columns of conventional pixels, a row of compensation pixels being between at least two adjacent rows of conventional pixels, and a column of compensation pixels being between at least two adjacent columns of conventional pixels, the method comprising:

acquiring a state of the stretchable display panel;

driving the compensation pixels between two adjacent columns of conventional pixels to emit light, in response to the stretchable display panel in a display state being stretched in a row direction;

driving the compensation pixels between two adjacent rows of conventional pixels to emit light, in response to the stretchable display panel in the display state being stretched in a column direction; and controlling the compensation pixels not to emit light, in response to the stretchable display panel being not stretched, wherein among the compensation pixels between two adjacent rows of conventional pixels, each compensation pixel has a size in the column direction smaller than a size in the column direction of the conventional pixel in the same column as the compensation pixel, among the compensation pixels between two adjacent columns of conventional pixels, each compensation pixel has a size in the row direction smaller than a size in the row direction of the conventional pixel in the same row as the compensation pixel, the display device comprises a first gate driving circuit and a second gate driving circuit; the method further comprises:

scanning, by the first gate driving circuit, the conventional pixels column by column, and supplying data signals to the scanned conventional pixels; and scanning, by the second gate driving circuit, the compensation pixels column by column, and supplying data signals to the scanned compensation pixels, and light emission luminance of the compensation pixels is an average light emission luminance of the conventional pixels adjacent thereto.

9. The driving method of claim 8, wherein at least one first conductive line extending in the row direction and at least one second conductive line extending in the column direction are on the stretchable display panel, and the method further comprises:

detecting resistances of the first conductive line and the second conductive line;

determining that the stretchable display panel is stretched in the row direction, in response to the resistance of the first conductive line increasing from its initial value to a first threshold value; and determining that the stretchable display panel is stretched in the column direction, in response to the resistance of the second conductive line increasing from its initial value to a second threshold value.

* * * * *